United States Patent [19]

Kawada

[11] 4,302,198

[45] Nov. 24, 1981

[54] ODD COPIES BUNDLING SYSTEM IN CONNECTION WITH FIXED COPIES AUTO-BUNDLING PROCESS

[75] Inventor: Tomoshi Kawada, Kawasaki, Japan

[73] Assignee: Kabushiki Kaisha Tokyo Kikai Seisakusho, Tokyo, Japan

[21] Appl. No.: 972,399

[22] Filed: Dec. 22, 1978

Related U.S. Application Data

[63] Continuation of Ser. No. 817,444, Jul. 20, 1977, abandoned.

[30] Foreign Application Priority Data

Jan. 26, 1977 [JP] Japan ..... 52-007543

[51] Int. Cl.[3] ..... B65H 45/14

[52] U.S. Cl. ..... 493/14; 209/3.3; 270/58; 271/303; 493/375; 493/419

[58] Field of Search ..... 270/20, 58, 61 R, 68 R, 270/82; 93/93 DP, 93 C, 93 M; 271/303, 305, 279, 298; 209/3.3, 584, 900; 493/10, 13, 14, 25, 375, 416, 419

[56] References Cited

U.S. PATENT DOCUMENTS

| | | | |
|---|---|---|---|
| 2,133,262 | 10/1938 | Wolff | 93/93 C |
| 3,364,827 | 1/1968 | Schmitz | 93/93 C |
| 3,568,578 | 3/1971 | Fugishiro | 93/93 C |
| 3,710,936 | 1/1973 | Mizunuma | 209/3.3 |
| 3,851,773 | 12/1974 | Kluge | 93/93 DP |
| 3,859,898 | 1/1975 | Besserdich | 93/93 DP |

*Primary Examiner*—Edgar S. Burr
*Assistant Examiner*—A. Heinz

[57] ABSTRACT

In a counter stacker for stacking and dividing every predetermined number of printed copies including a counter disposed on a first path of convey along which said copies are successively conveyed partially superimposed one on the other at a constant pitch of superimposing, a first dividing plate disposed on said path and adapted to be inserted between said copies, the above mentioned system has an odd copies dividing and delivering mechanism including a second dividing plate located at the same position with the first dividing plate or at least at a downstream side position of the first dividing plate and a second path only for odd copies and shunting from said first path at said second dividing plate.

The system further has means for actuating the first dividing plate in accordance with a sum of the standard number S of fixed copies and a number F of odd copies which is coded on a label to be attached to a bundle of odd copies, the means being adapted to actuate, only when the number F in not equal to zero, the second dividing plate when the standard number S has been counted, and means incorporating a folding device disposed on the path of odd copies and adapted to actuate the device only when the height of stacking of the odd copies is smaller than a threshold, to fold the copies across a longitudinal center to impart a sufficient strength to the later.

7 Claims, 27 Drawing Figures

ODD COPIES BUNDLING SYSTEM IN CONNECTION WITH FIXED COPIES AUTO-BUNDLING PROCESS

This is a continuation, of application Ser. No. 817,444, Filed July 20, 1977 now abandoned.

BACKGROUND OF THE INVENTION

Counter stackers have been widely used for bundling every predetermined number of printed sheets or copies such as newspapers, for example at every 25 sheets, the sheets being successively conveyed in a row with a constant pitch of overlapping one on the other.

The present invention is concerned with a system adapted to be used in connection with the process of bundling of sheets by such a counter stacker and, more particularly, to a system capable of producing bundles containing odd copies, i.e. copies of a number less than 25, upon receipt of an order as required.

In assortment and delivery of newspapers to dealers, the numbers of newspapers to be delivered to each dealer is not always a multiple of the number, e.g. 25 constituting one bundle. Namely, it is often necessary to deliver odd sheets, in addition to the sheets of bundles, in accordance with the expected sales accomplishment by each dealer.

However, unfortunately, a conventional counter stacker cannot perform the assortment or division of papers by too small numbers, for example less than 25 sheets, due to a high speed of delivery of the sheets from a rotary press, which well reaches 70,000 copies per hour. Therefore, for performing an automatical mechanical assortment for odd copies of a number less than that for a bundle, the rotary press had to be operated at a reduced speed which is quite incompatible with the promptness of the news reporting essential for the newspapers.

Conventionally, the odd copies have been prepared by manually breaking a bundle of papers which has been provided automatically to extract the required odd copies therefrom. In addition, since the odd copies make a thickness, when stacked one on the other, smaller than that of a bundle consisting of a predetermined number of copies, and, accordingly, lack stiffness to withstand external force expected during the transportation, they cannot be handled and transported in a condition of "quarto". Thus, troublesome works of folding the copies into "octavo", bundling the "octavo" copies and then attaching a label in which the name of the dealer is written onto the bundle of "octavo" odd copies.

It will be seen that the forwarding of the standard bundles of copies is inconveniently delayed, due to these troublesome and time consuming works.

Under these circumstances, the present invention is aiming at providing a total system capable of performing, as required, assortment and bundling of odd copies, in addition to and in connection with the ordinary standard assortment without requiring an undesirable reduction of speed of the rotary press, as well as folding of copies into "octavo" and addressing which have been performed manually.

Another object of the invention is to provide a system which is further improved to perform an automatic bundling and folding of odd copies having a stiffness optimum for the transportation, in accordance with the thickness of the bundle of odd copies.

A further object of the invention is provide an automatic and economical system having a odd copies bundling system related with a conventional assortment and bundling line for a standard number of copies, without substantially changing the line.

SUMMARY OF THE INVENTION

To sum up, according to the invention, there is provided a system related to a counter stacker for dividing every predetermined number of copies including a counter disposed on a path along which the copies are transferred successively partially overlapped by one another by a constant pitch of overlapping, and a first dividing plate disposed on said path and adapted to be inserted between adjacent groups of copies, the system having a mechanism including a second dividing plate located at the same position with the first dividing plate or at least at a downstream side position of the first dividing plate and a second path only for odd copies and shunting from said first path at said second dividing plate. The system further has means for actuating the first dividing plate in accordance with a sum of the standard number S of fixed copies and a number F of odd copies which is coded on a label to be attached to a bundle of odd copies, the means being adapted to actuate, only when the number F is not equal to zero, the second dividing plate when the standard number S has been counted, and means incorporating a folding device disposed on the path of the odd copies and adapted to actuate the device only when the height of stacking of the odd copies is smaller than a threshold, to fold the copies across a longitudinal center to impart a sufficient strength to the latter.

BRIEF DESCRIPTION OF THE DRAWINGS

The attached drawing show a practical embodiment of the present invention in which:

FIGS. 6 to 11 show a counting and dividing section of the system of the invention, wherein FIGS. 6 and 7 show the manner of standard copies dividing, FIGS. 8 to 11 show the manner of odd copies dividing operation in relation with the standard copies dividing operation, FIG. 14 is an enlarged left-hand side sectional elevational view of an essential part of FIG. 3, in which the right-hand side half correspond to the sectional view taken along the line 14—14 of FIG. 12, while the left-hand side half correspond to a section taken along the line 14—14 of FIG. 12, FIGS. 15 to 24 are illustrations for explaining the manner of operation of the folding mechanism shown at the right-hand side half of FIG. 14, wherein

DESCRIPTION OF THE PREFERRED EMBODIMENT

Figure 10:
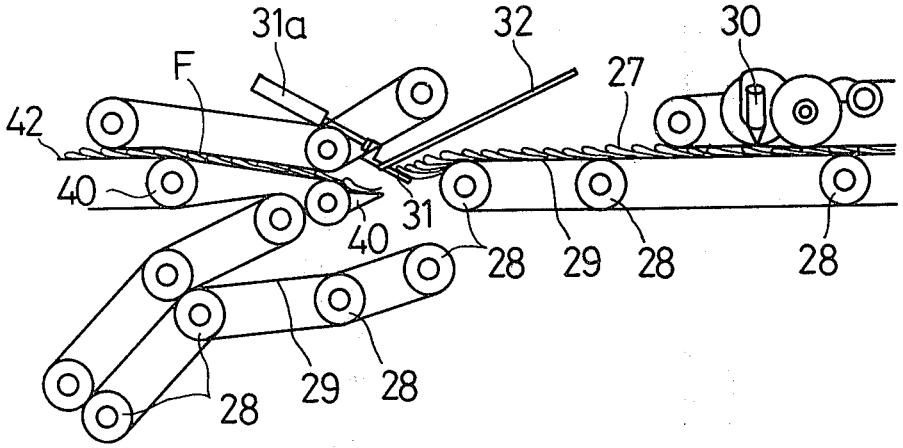

The invention will be more fully understood from the following description of preferred embodiments taken in conjunction with the attached drawings.

An arrangement for a conventional counter stacker for assortment of copies by a standard number will be explained at first, for an easier understanding of the invention.

Referring to the drawings, a conveyor constituting a first path of convey consists of a plurality of rollers 28, 28 . . . disposed between a pair of side frames 25 and 26, and wire belts 29, 29 . . . going round the rollers.

Figure 6:
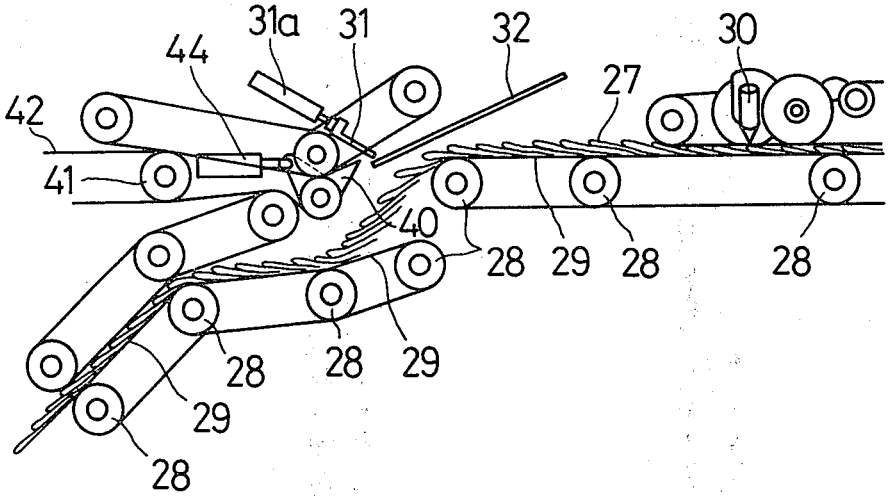

Printed matters or copies 27 arc conveyed successively in a row at a constant pitch of overlapping one on the other, as shown in FIG. 6, in such a manner that the leading edge of the trailing copy rides on the trailing edge of the leading copy.

A counter head 30 located at a suitable position along the conveyor is directed downwardly for contacting the upper surfaces of the copies being transferred to count the number of steps between the copies passed beneath the head and, accordingly, the number of the passed copies.

A first dividing plate 31 is located at a downstream side position of the counter head 30 and is disposed to oppose to the flow of the copies. The first dividing plate 31 is adapted to be inserted, by means of an air cylinder 31*a*, into the row of the copies thereby to stop the subsequent copies. A paper guide 32 is provided for limiting the stacking height of the staying subsequent copies, when the first dividing plate 31 is lowered.

Figure 2:
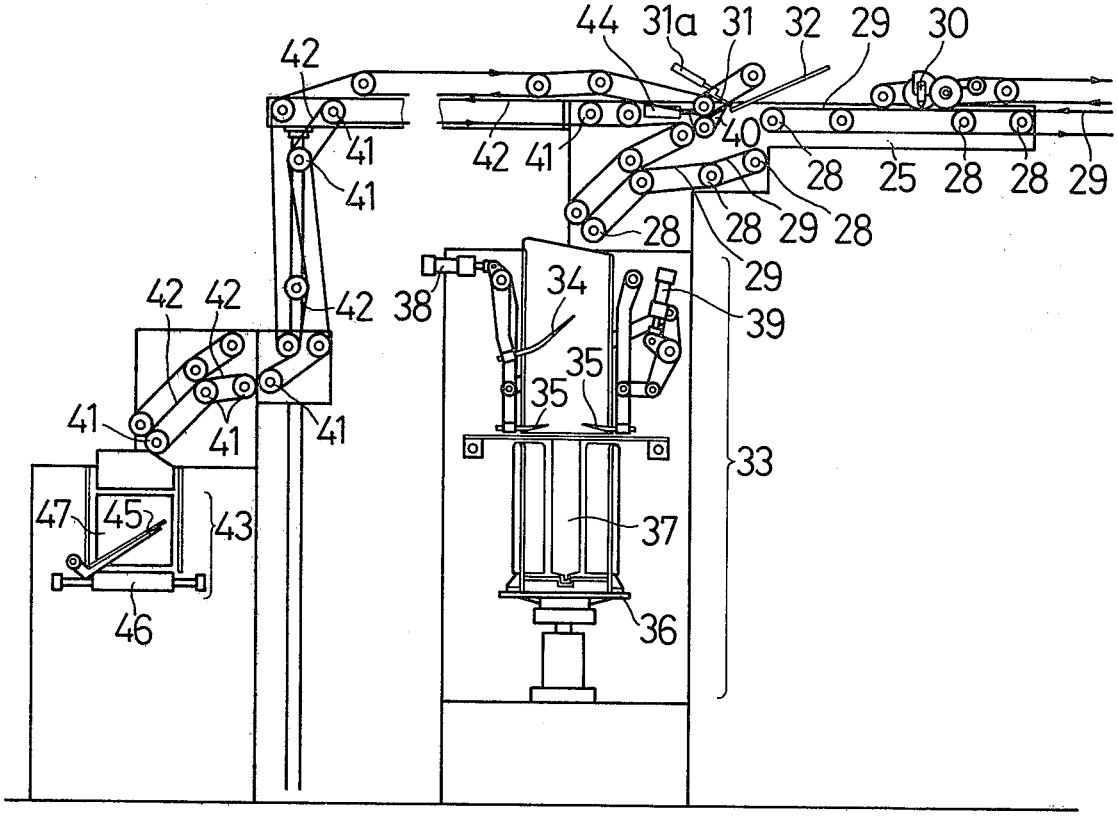
FIG. 2 is a front elevational sectional view taken along the line 2—2 of FIG. 1.

At the end of the first path of convey, there is provided a mechanism for stacking and delivering a standard number of copies. The mechanism includes, as shown in FIG. 2, an upper fork 34 and a lower fork 35, as well as a turning table 36 and a delivering pusher 37. The turning table 36 is provided with a basket and can turn over 180°.

As a predetermined number of copies have been transferred by the first path of convey and stacked on the upper fork 34, a hydraulic cylinder 38 is energized to retract the upper fork 34 to allow the stacked copies to drop onto the lower fork 35 on which the copies are held horizontally and trimmed. The trimmed batch of copies is then dropped onto the turning table 36, by a subsequent energization of a hydraulic cylinder 39 to retract the lower fork 35.

Since the turning table 36 makes a turn for each dropping of the successive batches by 180°, the batches are stacked alternatingly rotated by 180° from the adjacent ones. As a predetermined number of batches are stacked, the pusher 37 is actuated to take the superimposed batches out of the turning table 36.

Referring now to the sorting and taking-out mechanism for odd copies, the mechanism consists of a second dividing plate 40, a second path of convey constituted by a plurality of rollers 41, 41 . . . and wire belts 42, 42 . . . going around the rollers, and a stacking and delivering device 43 provided at the end of the second path of convey.

The second dividing plate 40 is disposed so as to position its end at the same position with the first dividing plate 31 or at least downstream thereof, and is disposed to oppose to the flow of the copies. An air cylinder 44 is adapted to actuate the second dividing plate 40 to cause the latter to get into the row of the flowing copies to switch the flow to the second path of convey.

As will be seen from FIG. 2, the stacking and delivering mechanism 43 for odd copies consists of a fork 45, a delivering roller 46 and a pusher 47. The arrangement is such that the fork 45 is lowered below the delivering roller 46, as the stacking of the odd copies is over, to open a gate to allow the pusher 47 to force the copies onto a conveyor 48.

The stacked odd copies are then conveyed by the delivering conveyor 48 (referred to as a first conveyor) and then by a conveyor 49 (referred to as a second conveyor), and are folded doubly, during the convey, for the purpose of stiffening, when the thickness of the stack is small.

This folding is performed by an automatic mechanism incorporating photoelectric convertors 50, 51 for detecting the height of the stack, a stopper 52 for upper half layers, a first photoelectric convertor 56, a first and a second fork 58, 59 and a second photoelectric converter 60.

The pair of photoelectric convertors 50, 51 are disposed one above the other on the first conveyor 48 close to the upstream side end of the latter 48, for discriminating the height of the stack of the copies into the following three categories.

(a) The stack height is so small that both of the photoelectric detecting convertors are not interrupted.

(b) The stack height is moderate to interrupt only the lower one of the photoelectric convertors.

(c) The stack height is so large that both of the photoelectric convertors are interrupted.

The subsequent step for folding the copies is performed depending on the result of the descrimination of the stack height as above.

As will be seen from FIGS. 1, 3, 13 and 14, the stopper 52 is stationed at a side of the first conveyor 48, downstream of and close to the photoelectric convertors 50, 51 for detecting the height of the stack, and is adapted to be forced to project above the conveyor 48, by means of an action of the air cylinder 53, only when the lower photoelectric convertor 51 solely is interrupted. As will be seen from FIG. 14, a gap is preserved between the projected stopper 52 and the surface of the first conveyor 48 to allow the lower half layers 54 copies to pass therethrough, so that only the upper half layers 55 of the copies are stopped by the stopper 52.

The first photoelectric convertor 56 is located at a downstream side position of the stopper 52 spaced by a distance equal to a half of the length of the copy from the stopper 52, and is adapted to be operated only when the stack height is medium, i.e. in case of the height (b). To explain in more detail, as the leading edge of the lower layers 54 having passed the gap between the stopper and the conveyor reaches the first photoelectric convertor 56 to interrupt the latter, the first conveyor 48 is stopped and the stopper 52 is retracted laterally of the conveyor 48. The conveyor 48 is then started again.

Figure 14:
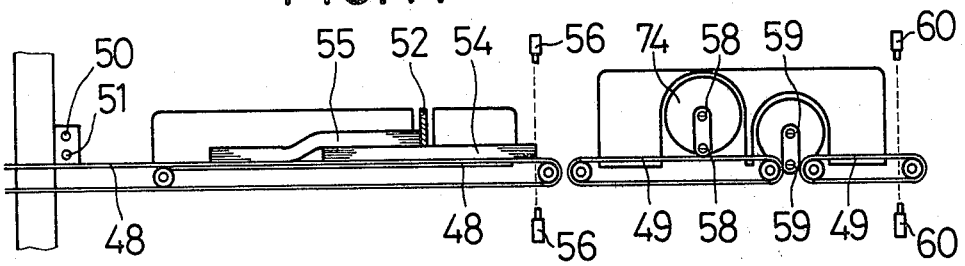

As shown in FIG. 14, the second conveyor 49 consists of a pair of endless belts arrayed in series and spaced from each other by a clearance for allowing the second forks 59, 59*a* to pass therethrough. The second photoelectric convertor 60 is disposed close to the end of the second conveyor 49, and is adapted to stop both of the endless belts when interrupted by the leading edge of the stack of copies.

The second forks 59 and 59*a* are disposed opposing to each other, at respective sides of the second conveyor 49, spaced in the upstream direction from the second photoelectric convertor 60 by a distance equal to a half of the length of the copy, and are directed inwardly of the conveyor to confront each other, at an equal height. Therefore, when the forks 59, 59*a* are extracted to lay over the conveyor 48, the lengthwise central portion of the lower half layers of the copies are clamped by rods constituting the forks 59, 59*a*.

The first forks 58 and 58*a* are located laterally of the second conveyor 49, spaced from the second forks 59, 59*a* in the upstream direction by a distance equal to the half of the length of the copy, and are directed inwardly of the conveyor 49 to oppose to each other at a same height. As will be seen from FIG. 14, the level of the first forks is slightly above that of the second forks. Therefore, as the first forking 58, 58*a* are extracted to lay above the second conveyor 49, the lengthwise central portion of the upper half layers 55 is clamped between two rods constituting the first forks.

The extraction of the first and second forks 58, 58*a* and 59, 59*a* are effected, through rods connected to the forks, by respective air cylinders 61, 61*a*, 62 and 62*a*.

As will be seen from FIG. 14 and subsequent Figures, the lower one of the rods constituting each pair of forks projecting above the second conveyor 49 is adapted to be rotated around the lower one by a half of complete or full rotation. The direction of the rotation is the same with that of the second conveyor 49 in case of the first forks 58, 58*a*, while, in case of the second forks 59, 59*a*, the direction is opposite to that of the second conveyor 49.

Figure 12:
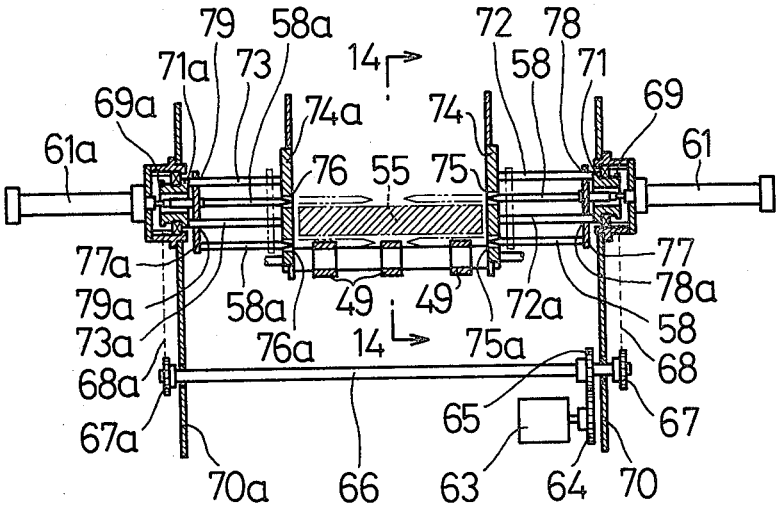
FIG. 12 is a front elevational sectional view of a mechanism for folding odd copies, taken along the line 12—12 of FIG. 1.
Figure 13:
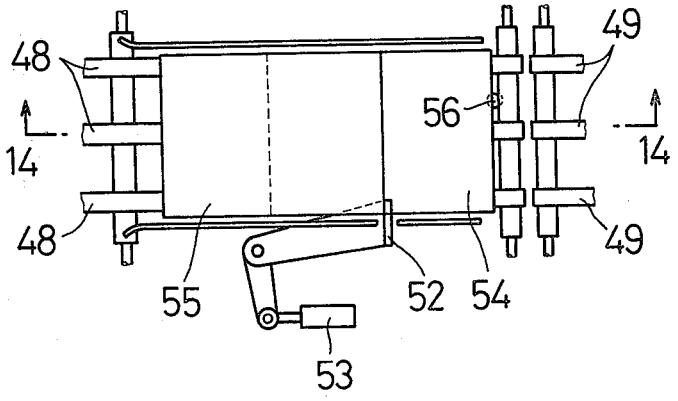
FIG. 13 is a plan view of a mechanism preparing for folder of the odd copies when the stack height of the odd copies is moderate.

The rotary motion of the forks will be more fully understood from the following description taken in conjunction with FIG. 12 which shows an arrangement for the first forks. Referring to FIG. 12, a rotary driving source 63 such as an angularly displaceable cylinder transmits an angular displacement, through gears 64, 65, to an intermediate shaft 66 which extends to both lateral and lower sides of the second conveyor 49. The angular displacement thus transmitted is then transmitted from sprocket wheels 67, 67*a* fixed to respective ends of the intermediate shafts 66, to sprocket wheels 69, 69*a*, through respective chains 68, 68*a*. The sprocket wheels 69, 69*a* are fixed to outer ends of sleeves 71, 71*a* which in turn are rotatably secured to side frames 70, 70*a* through respective bearings. The sleeves are disposed coaxially with the rods for projecting the first forks 58, 58*a* so as to avoid mutual interference. From the inner ends of respective sleeves 71, 71*a*, pairs of guiding rods 72, 72*a* and 73, 73*a* extend horizontally and inwardly, spaced angularly by 180° in each pair. The guide rods of respective pairs carry at their ends respective discs 74, 74*a* which have respective pairs of bores 75, 75*a* and 76, 76*a* for passing each one of the rods constituting the first forks 58, 58*a*. The rods have respective base plates 77, 77*a* each of which has a pair of bores 78, 78*a* and 79, 79*a* for passing the pairs of guide rods. Therefore, the angular displacements of the sleeves 71, 71*a* are transmitted to the first forks 58, 58*a*, through respective guide rods 72, 72*a* and 73, 73*a* which are fixed to the sleeves, and then through both of the discs 74, 74*a* and base plates 77, 77*a* of the forks.

Figure 15:
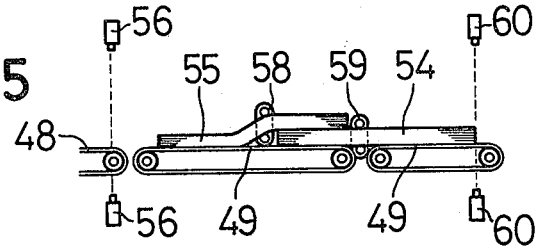
FIGS. 15 to 19 show the operation in case that the stack height of the odd copies is moderate.
Figure 16:
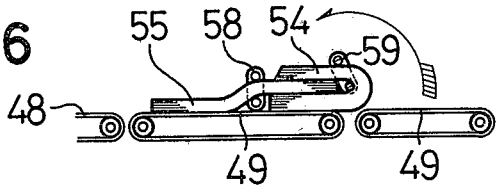
Figure 17:
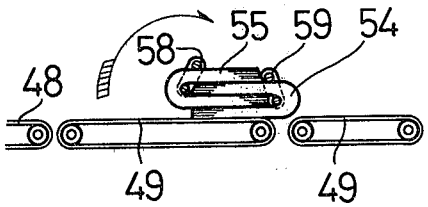
Figure 18:
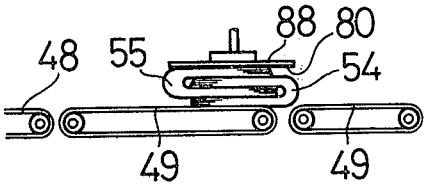
Figure 19:
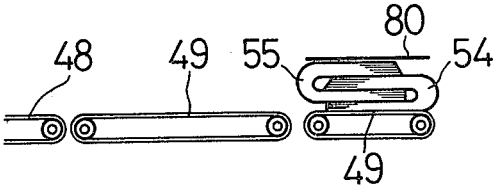
Figure 20:
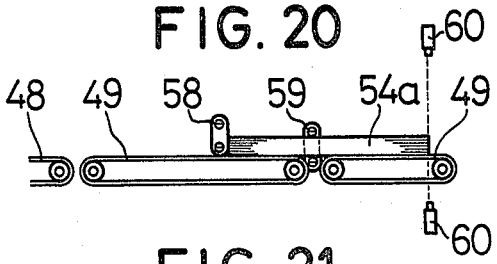
FIGS. 20 to 23 show the operation in case that the stack height of the odd copies is small.
Figure 21:
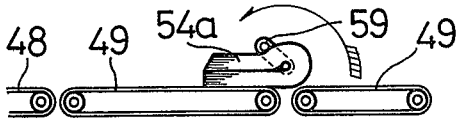

As shown in FIGS. 15 to 17, both of the rotating mechanisms for the first and the second forks are actuated when the height of the stacked copies on the second conveyor is medium, i.e. in case of the category (b), while, when the stack height is small, operation of only the second forks will suffice, as shown in FIGS. 20 and 21, although a simultaneous actuation of the first forks in the latter case does not cause a substantial problem.

Figure 24:
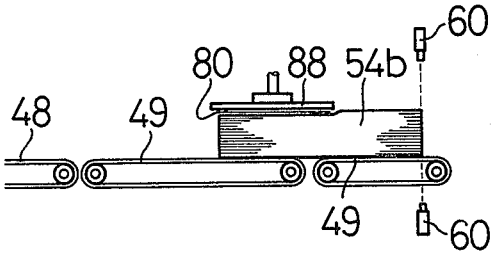
FIG. 24 shows the operation when the stack height of the odd copies is large.

When the height of the stacked copies is sufficiently large, none of the mechanism is actuated, as will be seen from FIG. 24.

Figure 3:
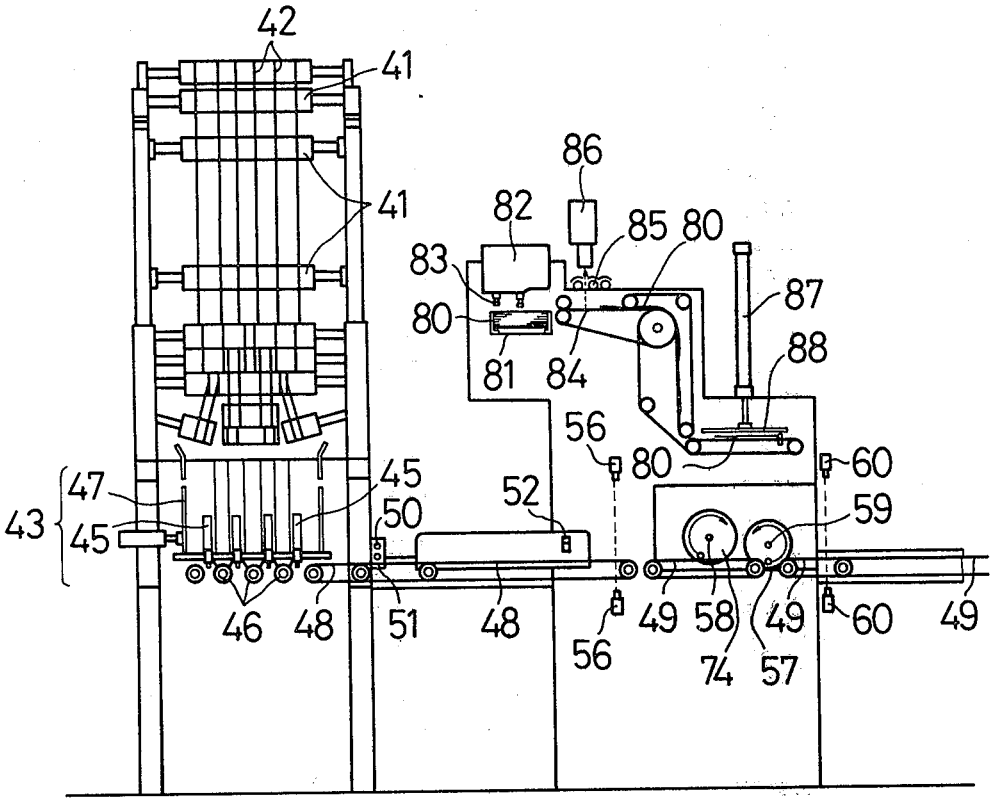
FIG. 3 is a left-hand side elevational sectional view taken along the line 3—3 of FIG. 1.
Figure 4:
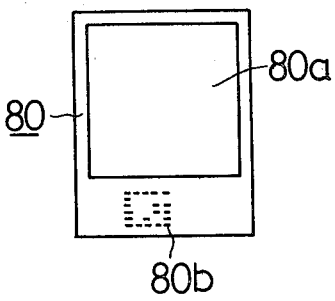
FIG. 4 is a plan view of a label for providing an order to the system of the invention.

As seen from FIG. 4, a code showing the number F of odd copies is recorded by pressing or punching as denoted by 80*b*, on a label 80 to be attached to the bundle of odd copies, outside of a column 80*a* for address. The labels 80 are accommodated by a container 81, as shown in FIG. 3. Feeding means 82 for feeding the labels incorporate a sucker 83 for sucking and delivering the label one after another, one by one, to a conveyor belt 84. A camera 86 is adapted to read the code 80*b* on the label, being assisted by a lamp 85. The read out data is used for issueing an order to the first and the second dividing plates 81, 40, so that the coded number F of odd copies may be delivered to the second path of convey, i.e. to the second conveyor 49. The label carried by the conveyor belt 84 has been transferred to a position above the folding mechanism, by the time when the folding operation is performed as required. The label 80 is then attached to the folded copies, by means of a pressing plate 88 adapted to be forced toward the second conveyor by an air cylinder 87.

The manner of operation of the system of the present invention will be detailed hereinafter.

Figure 5:
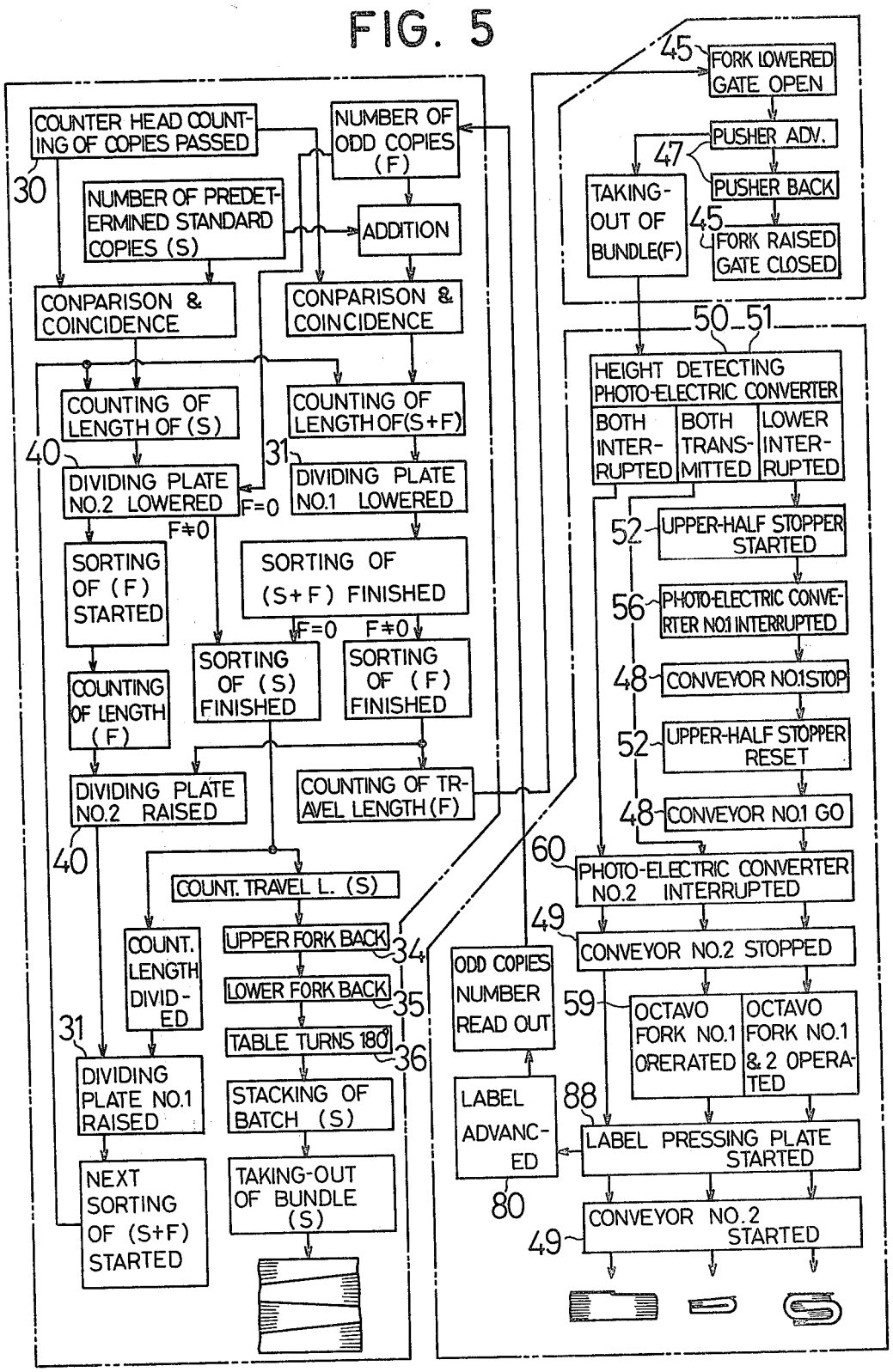
FIG. 5 is a flow chart illustrating the function of the system of the present invention.
Figure 7:
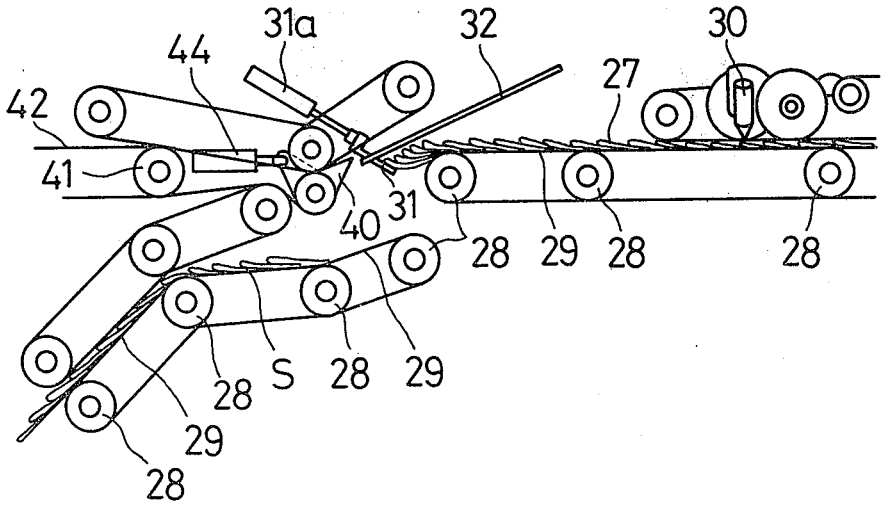

Referring to FIGS. 5 to 7, when there is no input of data of the number of odd copies, i.e. when the number of the odd copies F is zero, the number of copies counted by the counter head 80 is compared with the standard number S. When the counted number comes to coincide with the predetermined standard number S, the length of the copies of the number of S is counted and the first dividing plate 31 is lowered to be inserted into the row of the copies.

Consequently, the copies at the upstream side of the plate 31 are prevented from moving along the first path of convey, and are distinctively separated from the preceding copies the number of which being S.

Accordingly, the preceding copies of a number S are forwarded to the stacking and delivering mechanism 33 and are stacked on the turning table 36 having the basket, through the upper and lower forks 34, 35. When a predetermined number of batches of copies are stacked to form a larger batch, the pusher 37 is actuated to force the larger batch, i.e. the bundle out of the turning table.

Thus, the second dividing plate 40 does not act when there is no input of F, i.e. when only the standard number S is input.

Figure 8:
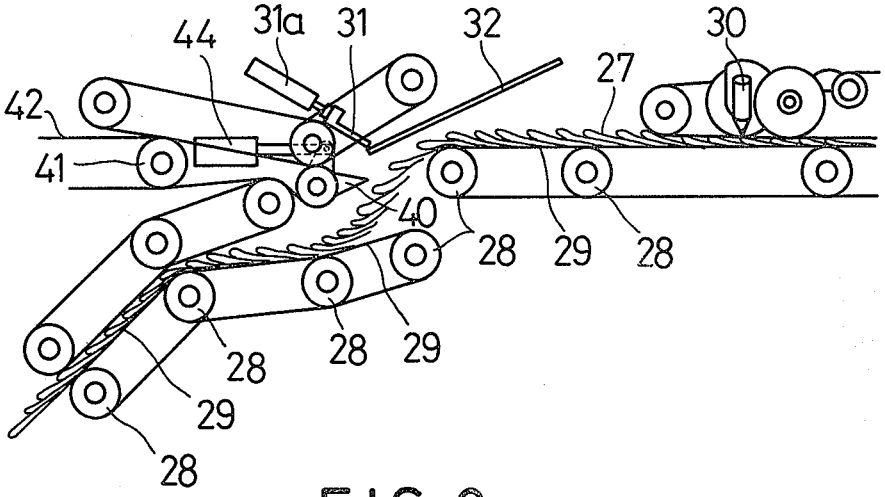
Figure 9:
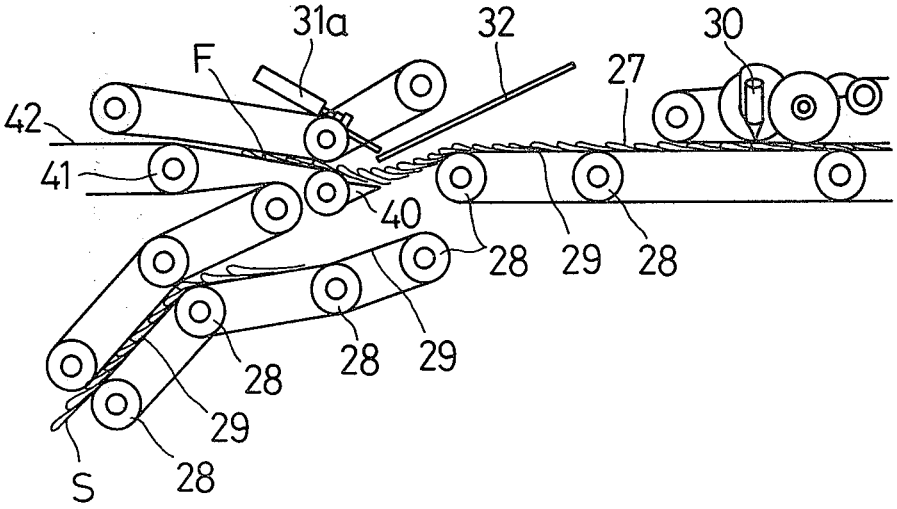

Supposing here that there is an input F by the data on the code 80*b* marked on the label 80, i.e. when F is not equal to zero, at first the second dividing plate 40 is lowered as the standard number S of copies have passed, thereby to complete an assortment of the standard number S of copies, as shown in FIGS. 5 and 8 to 11, and, thereafter, to direct the subsequent copies to the second path of convey for the assortment of the coded number F of odd copies, as will be most clearly seen from FIGS. 8 and 9.

On the other hand, the first dividing plate 31 is lowered, soon after the sum of F and S of the copies has passed, to stop the subsequent flow of the copies, as shown in FIG. 10.

Consequently, the first dividing plate 31 performs a separation of S+F of copies. However, due to the assortment of the odd copies performed by the second dividing plate 40, only the standard number S of the copies are left on the first path of convey, while the remainder, i.e. F copies have been forwarded to the second path of travel.

Figure 11:
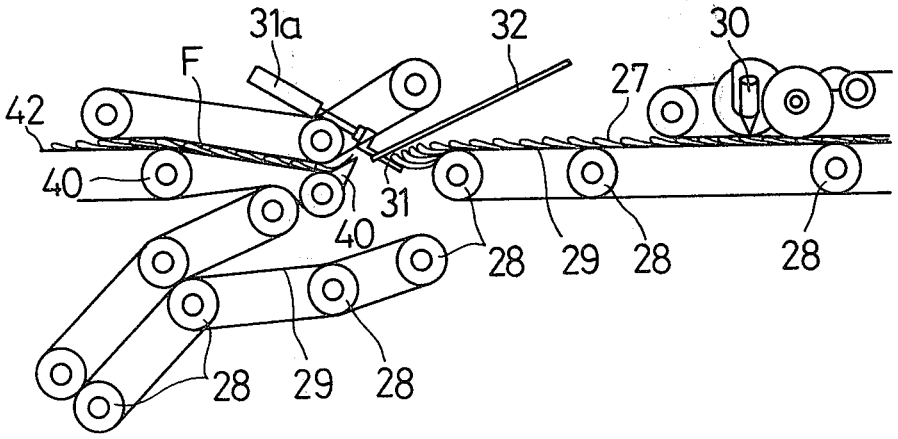
Figure 1:
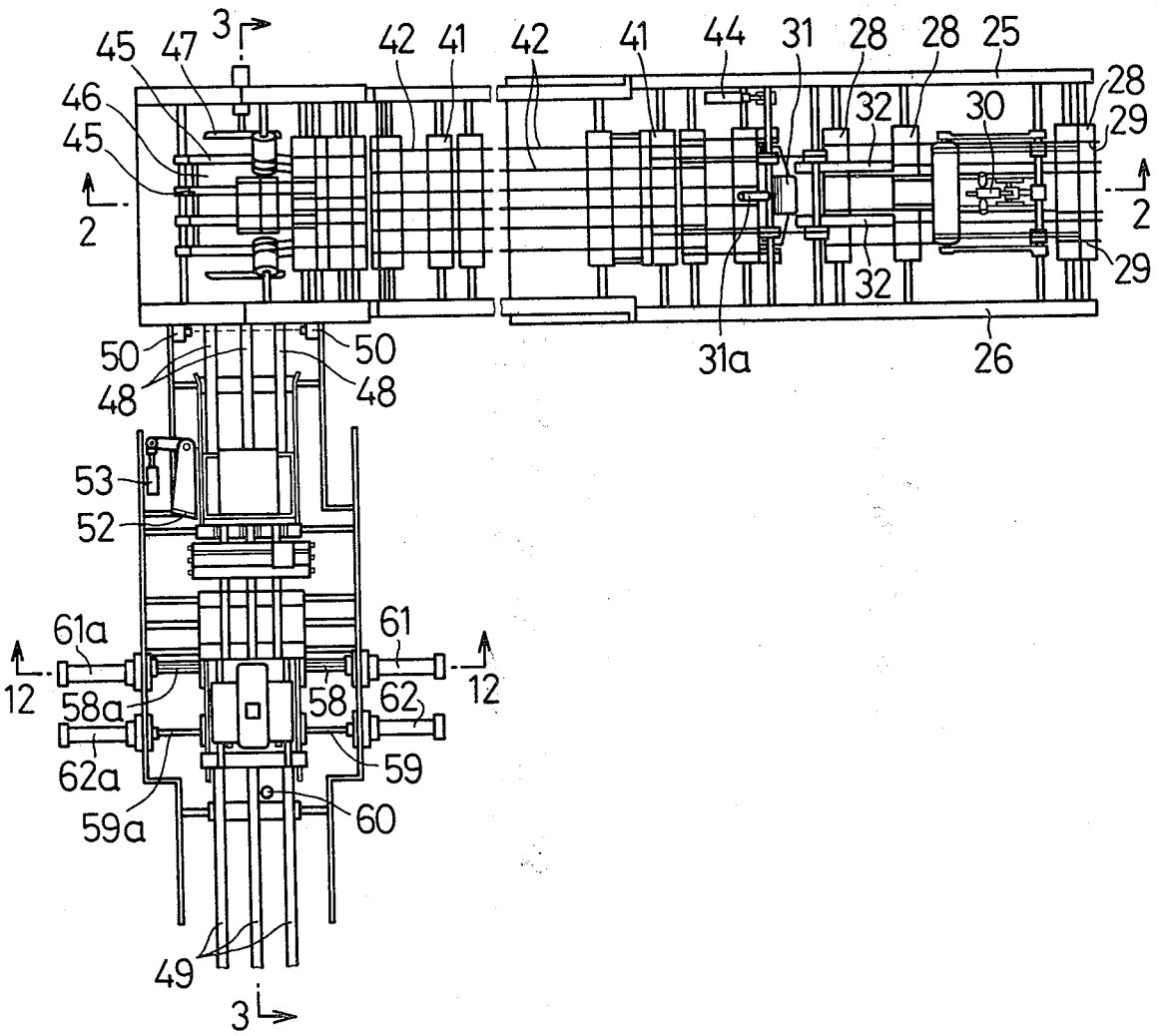
FIG. 1 is a plan view.

As shown in FIG. 11, the first dividing plate 31 is returned to its original position, only after the resetting of the second dividing plate 40.

The operations of the dividing plates must be performed taking the difference in the distances between counting position 30 and the positions of the dividing plates 31, 40 into account when the distance between the counting position and the first dividing plate is not equal to that between the counting position and the second dividing plate.

At the same time, assuming that there is a fluctuation of the pitch at which the successive copies are overlapped one on the other to cause the total length of the train of copies to fluctuate, the dividing plates are preferably operated in accordance with the measured length of the train of the copies.

The end structures of the first and the second paths of convey may be replaced with each other. In such an arrangement, the second dividing plate is normally lowered and is raised when the assortment of the odd copies is to be performed.

The odd copies F directed to the second path 42 of convey are then stacked on the fork 45 of the odd copies stacking and delivering mechanism 43. A subsequent lowering of the fork 45 allows the delivery of the copies by the pusher 47 onto the first conveyor 48.

At the upstream end portion of the first conveyor 48, there are provided a pair of vertically spaced stack-height detecting photoelectric convertors 50, 51 for discriminating the height of the stack of the copies, as mentioned before, into the following three cases: (a) the height is so small that none of the photoelectric convertors are interrupted, (b) the height is moderate so that only the lower photoelectric detector 51 is interrupted and (c) the height is so large that both of the photoelectric convertors are interrupted.

Figure 22:
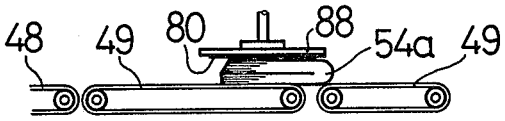
Figure 23:
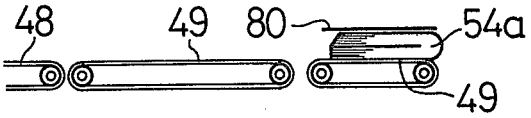

In case of (a) above, none of the stopper 52 for the upper layers and first forks 58, **58*a* are actuated. The second conveyor 49 is stopped when the leading edge of the stack of copies reaches the second photoelectric convertor 60 to interrupt the latter, as shown in FIG. 20. Subsequently, the air cylinders 62, 62*a* acts to extrude respective second forks 59, 59*a* over the second conveyor 49, so that the rods constituting the second forks may clamp the intermediate or central portion of the copies 54*a*. The second fork is then rotated around the upper rod, by a half of a cycle, in the direction opposite to that in which the second conveyor 49 rotates, thereby to fold the copies as shown in FIG. 21. Subsequently, the forks 59, 59*a* are retracted laterally of the second conveyor 49, by respective air cylinders 62 and 62*a*. Finally, the pressing plate 88 is lowered by the air cylinder 87 to attach the label 80 to the copy 54*a* as shown in FIG. 22. Then, the second conveyor 49 is started again to commence the forwarding of the copies as shown in FIG. 23**.

In case of (b) above, the stopper 52 is put ahead by the air cylinder 53 to lay above the first conveyor 48. Consequently, upper half layers 55 of the copies are retained by the stopper. As the lower half layers 54 of the copies which has cleared the stopper have travelled a distance equal to the half of the length of the copy, the leading edge thereof come to interrupt the first photoelectric convertor 56 to stop the first conveyor 48. Accordingly, the upper layers 55 of the copies are left behind the lower layers 54 by a distance equal to the half of the length of the copy. As the first conveyor 48 is started again, the copies reach the second conveyor 49, so that the leading edge of the copies come to interrupt the second photoelectric convertor 60 thereby to stop the second conveyor 49. At this moment, the first forks 58, **58*a* and the second forks 59, 59*a* are simultaneously forced laterally inwardly to lay above the second conveyor 49, so that the middle portions of the upper and lower halves of layers 54, 55 are clamped by the rods of respective forks, as will be seen from FIG. 15. Then, the second forks 59, 59*a* make a half turn, as shown in FIG. 16, so that the leading half of the lower layers 54 is laid on the leading half of the upper layers 55, while the first forks 58, 58*a* make a half turn to fold the trailing half of the upper layers 55 onto the trailing half of the lower layers 54, thus completing the folding. The first and the second forks 58, 58*a*, 59, 59*a* are then retracted by respective air cylinders 61, 61*a*, 62, 62*a* laterally of the second conveyor 49. Finally, the pressing plate 88 is lowered by the air cylinder 87 to apply the label 86 onto the copy. The second conveyor 49** is then started again to allow the forwarding of the copies.

In case of (c) above none of the first and the second forks 58, **58*a*, 59, 59*a* are actuated, so that the copies are allowed until the leading edge comes to interrupt the second photoelectric convertor 60. At this moment, the pressing plate 88 is lowered by the air cylinder 87 to attach the label 80 onto the copy 54*b* (see FIG. 24), and then the second conveyor 49** is allowed to move, for the delivery of the copies.

It will be seen that, when the copies in the state of quarto undergo the folding mechanism, they are folded into the state of octavo.

As have been described, according to the invention, odd copies are optionally and automatically bundled, during the bundling process of the standard copies, by a close cooperation of the first and the second dividing plates 31, 40 in accordance with an order representing the number of odd copies to be bundled, the number being expressed on a label adapted to be attached to the bundle of the odd copies to be obtained.

In addition, when the thickness of the bundle of the odd copies is too small to withstand an external force expected in the transportation, the folding mechanism of the apparatus of the invention conveniently folds the stack of the odd copies, for example from the state of quarto to the state of octavo.

Therefore, the bundling of odd copies which has been conventionally performed entirely manually can be accomplished exactly and perfectly automatically, without reducing the speed of operation of the rotary press.

Furthermore, the apparatus of the invention can advantageously and economically be applied to a conventional fixed copies bundling line, without substantially modifying the later, through simple interlocking means, contributing greatly to improve the efficiency in assortment of the printed matters.

What is claimed is:

1. In a counter stacker, for dividing predetermined numbers S of printed copies, wherein S is the minimum number of copies able to be automatically divided in full speed printing, including a first path of conveyance, a counter for counting the number of printed copies disposed at a position along the first path of conveyance along which said copies are successively conveyed partially superimposed one on the other at a constant pitch of superimposing, a first dividing plate disposed at a position downstream from said counter along said first path of conveyance and adapted to be inserted between said copies, and a stacking and delivering means disposed at the end of said first path of conveyance, an odd copies delivery system for delivering odd copies F wherein F is a lesser number than the predetermined number S of printed copies, characterized by comprising:

a second dividing plate for shunting printed copies on the first path of conveyance to a second path of conveyance, said second plate being located at substantially the same position as said first dividing plate, the second path of conveyance branching from said first path of conveyance at said second dividing plate, another stacking and delivering means disposed at the end of said second path of conveyance, means for attaching labels onto bundles of said odd copies, on each of which is an address and a code for which the number F of said odd copies to be obtained is expressed, means for effecting a first comparison of the sum of the predetermined number S of copies and the number F, including F=0, of said odd copies of a number of passing copies actually counted by said counter, a mechanism for controlling said first dividing plate including means for moving said first dividing plate into said first path of conveyance to stop the flow of passing copies when the number counted by said counter reaches the sum of S+F, means for effecting a second comparison of the predetermined number S of copies with a number of passing copies actually counted by said counter, only when F is not equal to zero, and a mechanism for controlling said second dividing plate including means for moving said second dividing plate into said first path of conveyance when the number F of said odd copies is not equal to zero to divide the flow of passing copies such that said predetermined number S of copies is moved along said first path of conveyance and said number F of copies is directed along said second path of conveyance, said second dividing plate being actuated only after the second predetermined number S of copies have been counted by said counter.

2. A system as claimed in claim 1, wherein there is provided a mechanism for folding the odd copies including a pair of photo-electric convertors disposed along a path for delivering said odd copies, said convertors being vertically spaced from each other for discriminating the height of stacks of odd copies into three categories of high, medium and low, a stopper mechanism for acting on the upper half portion of a stack of said odd copies and being actuated when said height of said stack is discriminated to be medium for displacing the upper half portion of said stack from the lower half portion of the same stack by a distance equal to one half of the longitudinal length of the stack, a first and second set of forks disposed laterally of said path for delivering said odd copies spaced from each other by a distance equal to one half of said longitudinal length of said stack and being projected to lay above said path for delivering said odd copies when said height of said stack is discriminated to be medium, said first and second sets of forks being rotated through ½ of one revolution when they are projected, and means for stopping conveyors provided for said path for delivering said odd copies when the forks are operated.

3. A system as claimed in claim 2, wherein said first dividing plate is returned to a position out of said first path of conveyance after said second dividing plate has been returned to a position out of said first path of conveyance.

4. A system as claimed in claim 2, wherein the lower half portion of said stack is displaced to lead the upper half portion of said stack, said first set of forks is rotated to fold the leading half of the lower half portion of said stack onto the leading half of said upper half portion of said stack, and said second set of forks is rotated to fold the trailing half of said upper half portion of said stack onto said leading half of said lower half portion of said stack.

5. A system as claimed in claim 2, wherein said first and second set of forks are projected and rotated only when said height of said stack is discriminated to be medium.

6. A system as claimed in claim 1, wherein there is provided a mechanism for folding the odd copies including a pair of photo-electric convertors disposed along a path for delivering said odd copies, said convertors being vertically spaced from each other for discriminating the height of stacks of odd copies into three categories of high, medium and low, at least one set of forks disposed laterally of said path for delivering said odd copies and being projected to lay above said path for delivering said odd copies when the height of a stack is discriminated to be low, said at least one set of forks being rotated through ½ of one revolution when projected to fold the stack upon itself, and means for stopping a conveyor provided for said path for delivering said odd copies when said at least one set of forks is operated.

7. A system as claimed in claim 1, wherein said first dividing plate is returned to a position out of said first path of conveyance after said second dividing plate has been return to a position out of said first path of conveyance.

* * * * *